US006923139B1

(12) United States Patent
Robichaux et al.

(10) Patent No.: US 6,923,139 B1
(45) Date of Patent: Aug. 2, 2005

(54) STRUCTURAL SUPPORT AND SEATING SYSTEM FOR WATERCRAFT

(75) Inventors: Jean-Luc Robichaux, Ferndale, WA (US); Murray Hamilton, LaConner, WA (US); Andrew S. Gladwin, Brentwood Bay (CA)

(73) Assignee: Johnson Outdoors Inc., Sturtevant, WI (US)

( * ) Notice: Subject to any disclaimer, the term of this patent is extended or adjusted under 35 U.S.C. 154(b) by 0 days.

(21) Appl. No.: 10/634,648

(22) Filed: Aug. 5, 2003

(51) Int. Cl.[7] ..... B63B 35/00
(52) U.S. Cl. ..... 114/347; 114/363
(58) Field of Search ..... 114/347, 363

(56) References Cited

U.S. PATENT DOCUMENTS 4,229,850 A * 10/1980 Arcouette ..... 114/347
4,480,579 A 11/1984 Masters
4,589,365 A 5/1986 Masters
4,715,311 A 12/1987 Masters
4,745,874 A * 5/1988 Everett ..... 114/347
6,065,421 A 5/2000 Haller et al.
6,105,531 A 8/2000 Knight
6,443,089 B1 9/2002 Goucher et al.
6,523,492 B1 2/2003 Neckar et al.
6,644,233 B2 11/2003 Batt et al.
6,718,905 B1 * 4/2004 Peerson et al. ..... 114/347
6,736,084 B2 5/2004 McDonough et al.
2002/0175549 A1 11/2002 Hamilton et al.

FOREIGN PATENT DOCUMENTS

GB 2 134 454 8/1984

* cited by examiner

*Primary Examiner*—Jesus D. Sotelo
(74) *Attorney, Agent, or Firm*—Foley & Lardner LLP

(57) ABSTRACT

A that receives impact energy from its environment during use is disclosed. The watercraft comprising a hull, a deck coupled to the hull, and an apparatus that provides structural support to the hull and the deck. The apparatus comprises a member disposed along an interior surface of the hull and extending along at least a portion of the longitudinal direction of the hull, and a first support coupled to the member and the deck. The apparatus is configured to return at least a portion of the energy to the environment. An apparatus to provide structural support for a watercraft having a hull and a deck and configured to receive impact energy from its environment during use is also disclosed. The apparatus comprises a member coupled to the hull and extending along at least a portion of the longitudinal direction of the hull, a front support coupled to the deck and the member, and a rear support coupled to the deck and the member. The member and the front support and the rear support are configured to return at least a substantial portion of the impact energy from the watercraft to the environment.

27 Claims, 5 Drawing Sheets

STRUCTURAL SUPPORT AND SEATING SYSTEM FOR WATERCRAFT

FIELD OF THE INVENTION

The present invention relates to a seating and structural support system for watercraft.

BACKGROUND

Water-going crafts such as sit-in kayaks, sit-on-top kayaks, and canoes are often subjected to forces that can cause the hull to flex, bend, contort, or the like. These forces, for example, are commonly experienced in whitewater kayaking. Sometimes, it is desirable that these forces not be absorbed by the watercraft. For example when a whitewater kayaker wants the watercraft to become airborne to perform aerial maneuvers, the kayaker will position the watercraft, with respect to the waves, in order to create forces strong enough to propel the kayak out of the water. If the hull flexes under the strain of these forces, some of the energy that would propel the kayak vertically will be absorbed by the hull and/or otherwise distributed throughout the watercraft. When this happens, the kayak does not attain as high of vertical above the water as it would have if the hull had not flexed or if the energy was redirected (or rebounded) from the kayak.

It is known to provide kayaks and other watercrafts (particularly those intended for aerial maneuvers) with thickened hulls to make them relatively rigid and not flex. One drawback to the use of a thickened hull is an increase in weight. However, the increase in weight reduces the height a kayak can reach when it is propelled out of the water. Also, heavier watercrafts may be harder to maneuver, thereby making certain "tricks" harder to perform. Further, thickened hulls do not always provide the desired energy recoil (e.g., bounce back, spring back, return, rebound, etc.) or provide enough structural support throughout the watercraft, including where grab loops are coupled to the deck. Further, hull flexing, and even damage to the watercraft, can occur when forces are applied to the grab loops fastened to the deck of the watercraft.

Accordingly, it would be advantageous to provide a watercraft with a structural support system that increases the rigidity of the hull. It would be advantageous to provide a watercraft with a structural support system that minimizes any increase in weight. It would also be advantageous to provide and/or incorporate the support system with an adjustable seat. It would also be advantageous to provide a watercraft with a support system such that grab loops located on the deck of the watercraft could be coupled to the support system thus spreading forces experienced by the grab loops over the whole of the support system. Furthermore, it would be advantageous to provide a watercraft with adjustable thigh braces that could be adjusted to accommodate kayakers of various sizes, and provide structural support for the plastic coaming of the watercraft. It would be desirable to provide for a seating and structural support system for watercraft having one or more of these or other advantageous features.

SUMMARY

One embodiment of the invention relates to a watercraft that receives impact energy from its environment during use. The watercraft comprises a hull, a deck coupled to the hull, and an apparatus that provides structural support to the hull and the deck. The apparatus comprises a member disposed along an interior surface of the hull and extending along at least a portion of the longitudinal direction of the hull, and a first support coupled to the member and the deck. The apparatus is configured to return at least a portion of the energy to the environment.

Another embodiment of the invention also relates to a an apparatus to provide structural support for a watercraft having a hull and a deck and configured to receive impact energy from its environment during use. The apparatus comprises a member coupled to the hull and extending along at least a portion of the longitudinal direction of the hull, and a first support coupled to the member and the deck. The member and the first support are configured to return at least a portion of the energy to the environment.

Another embodiment of the invention reatetes to an apparatus to provide structural support for a watercraft having a hull and a deck and configured to receive impact energy from its environment during use. The apparatus comprises a member coupled to the hull and extending along at least a portion of the longitudinal direction of the hull, a front support coupled to the deck and the member, and a rear support coupled to the deck and the member. The member and the front support and the rear support are configured to return at least a substantial portion of the impact energy from the watercraft to the environment.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF PREFERRED AND OTHER EXEMPLARY EMBODIMENTS

Figure 1:
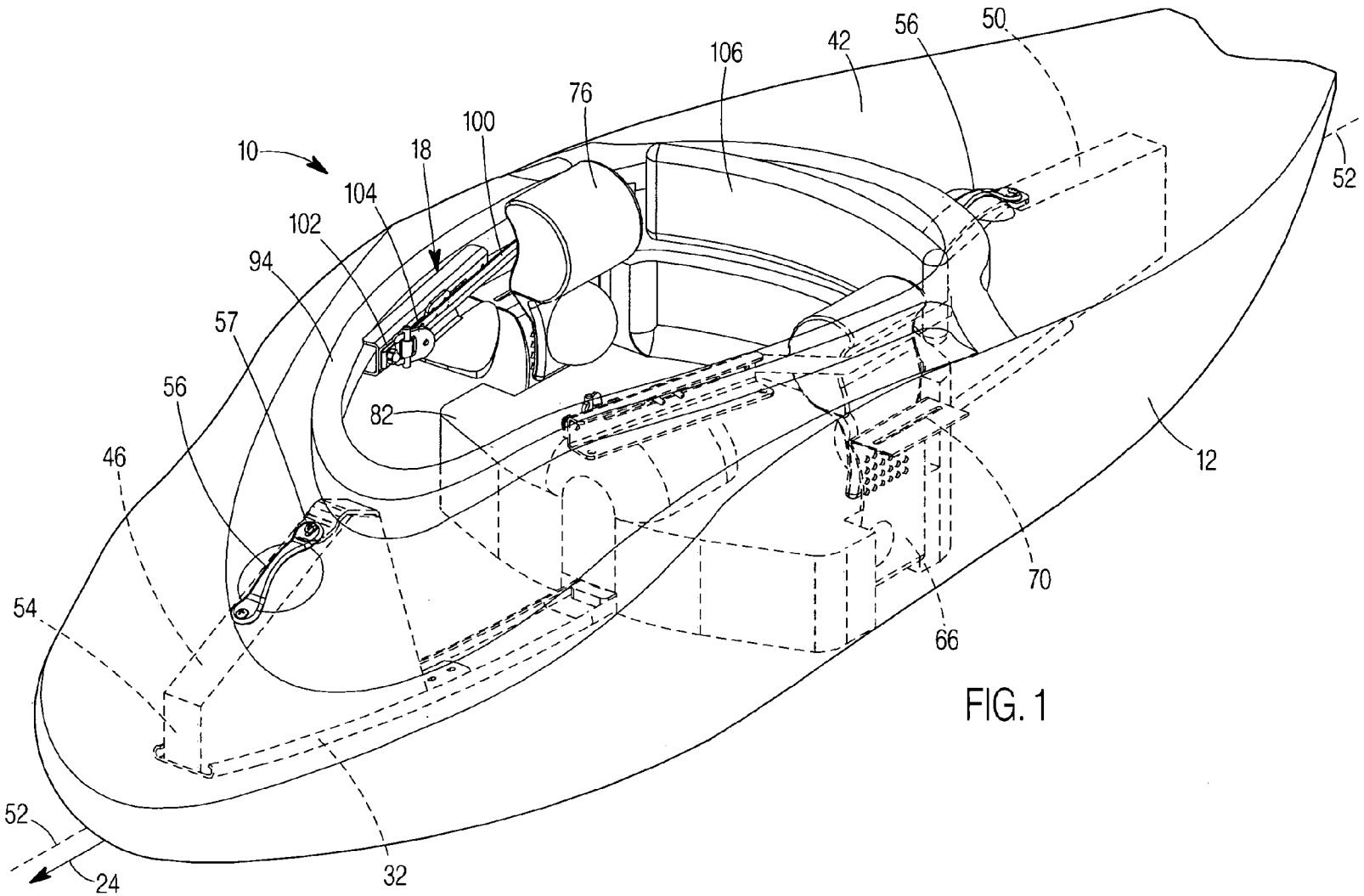
FIG. 1 is a perspective view of a watercraft according to a preferred embodiment with structural support system, adjustable seat system, and an adjustable thigh brace system.

FIG. 1 illustrates a watercraft 10 according to a preferred embodiment. Watercraft 10 includes a hull 12, a structural support system 14, an adjustable seating system 16, and an adjustable thigh braces system 18.

Hull 12 of watercraft 10 has an outer surface 20 and an inner surface 22. Outer surface 20 comes into contact with the water when watercraft 10 is in use, while inner surface 22 defines a cockpit in which the individual or individuals providing the power to propel watercraft 10 can be seated. Watercraft 10 can be any of a variety of water-going vessel that is conventionally known in the art or which is hereafter developed. The exemplary watercraft shown in the FIG- URES is a kayak, but it is understood that the present invention may be used with any of a variety of watercraft. For purposes of the following description, the front and rear direction designations shall be defined with respect to the direction the individual or individuals powering the watercraft face when seated in watercraft 10, not necessarily with respect to the direction watercraft 10 travels. An arrow 24 in FIGS. 1–3 indicates the direction an individual will be facing when seated in watercraft 10, and therefore points towards the front.

Figure 2:
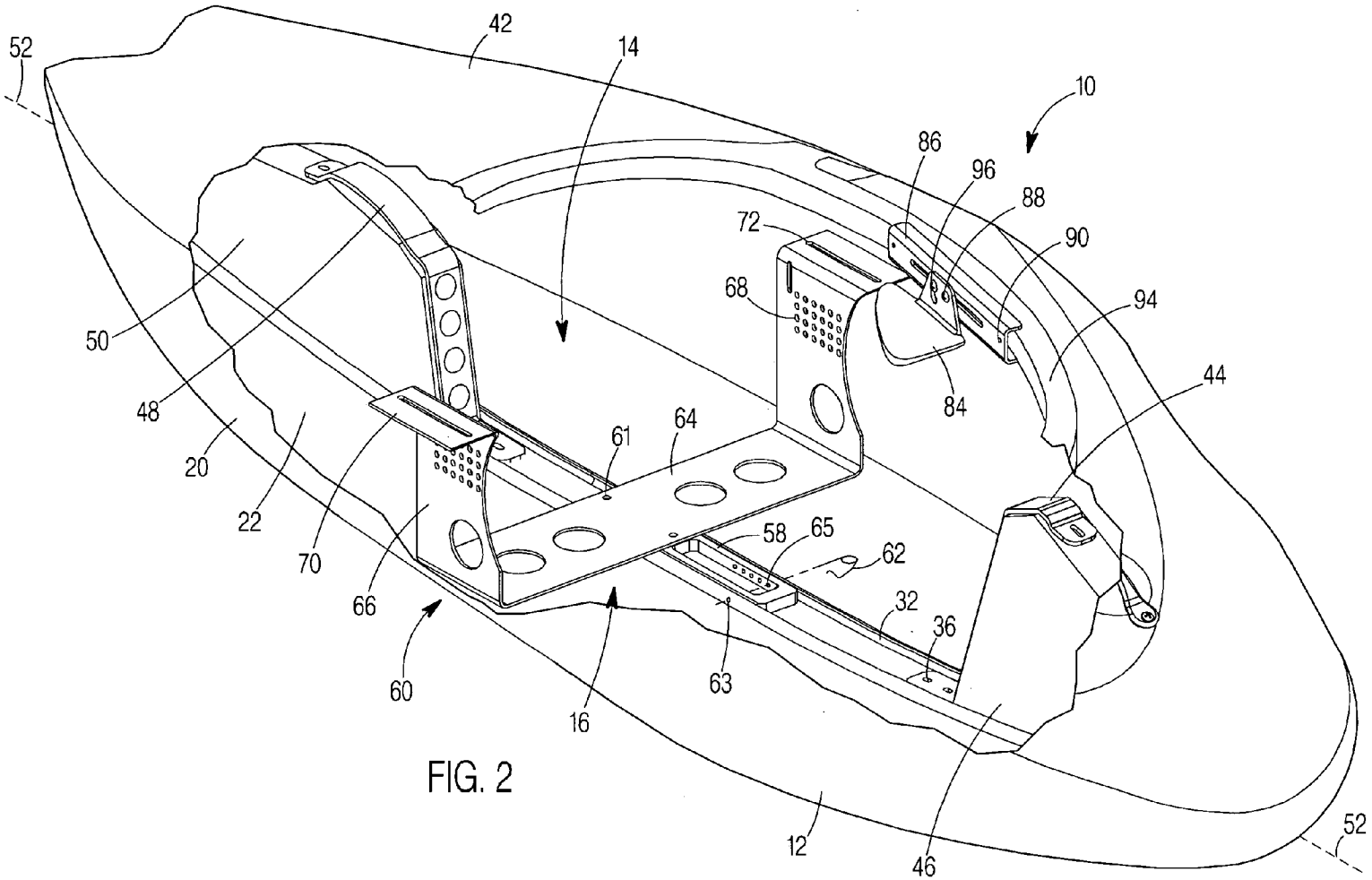
FIG. 2 is a fragmentary perspective view of the watercraft of FIG. 1.
Figure 3:
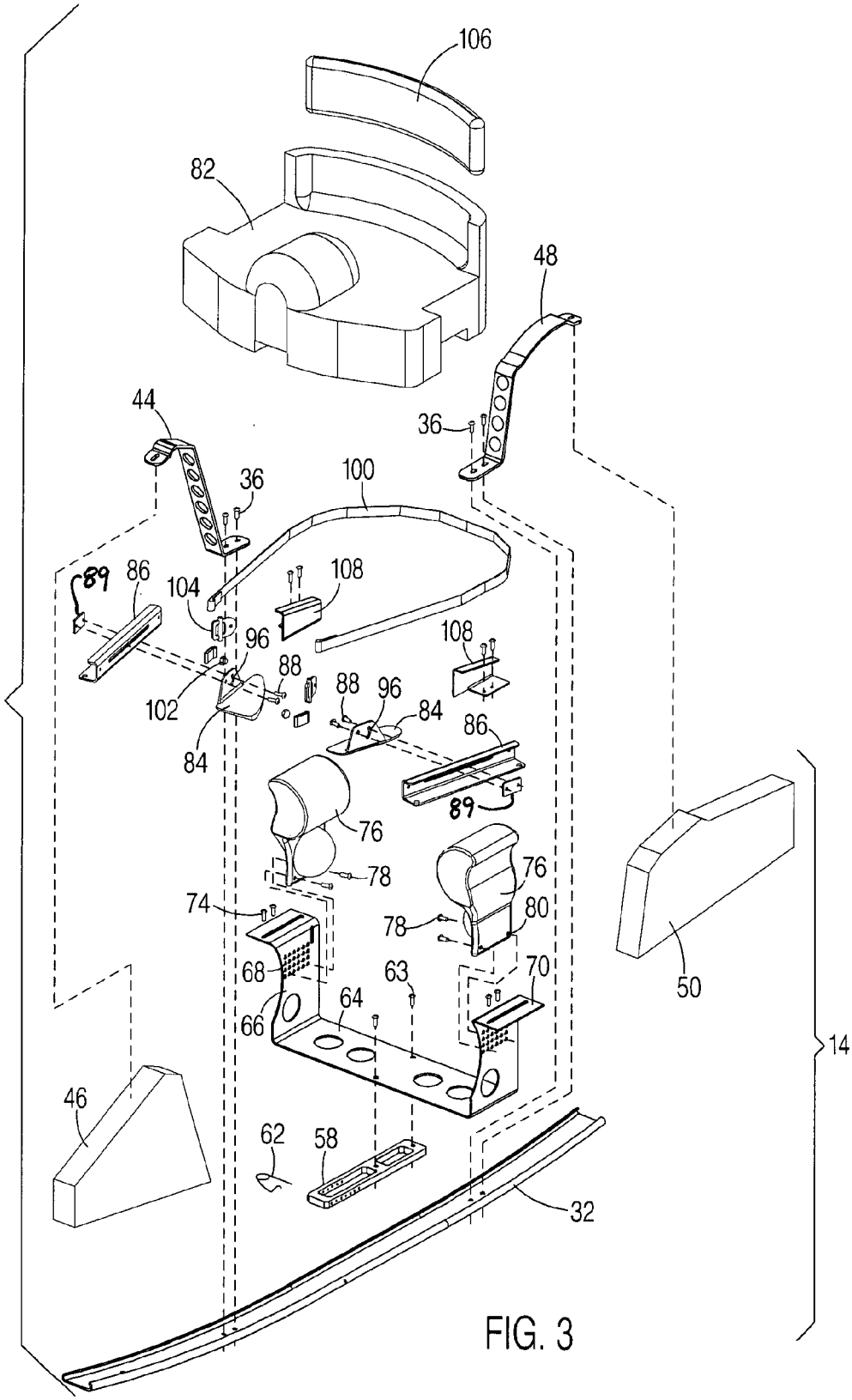
FIG. 3 is an exploded perspective view of the structure support system, adjustable seat system, and adjustable thigh brace system.
Figure 4:
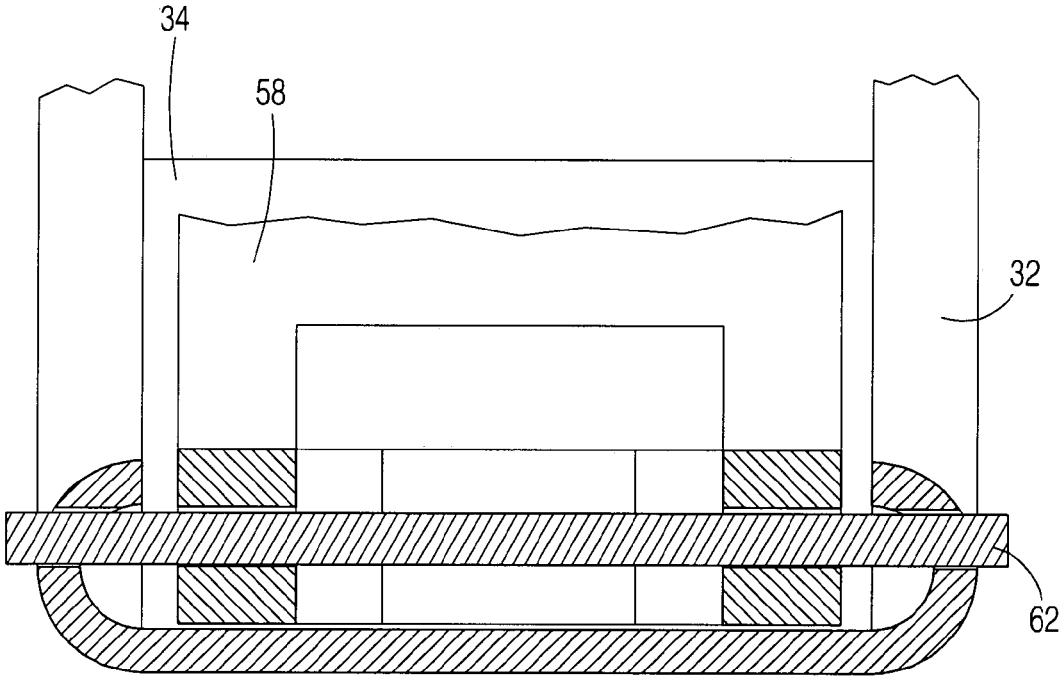
FIG. 4 is a sectional view of a portion of the structural support system and a portion of the adjustable seat system according to a preferred an exemplary embodiment.

Referring to FIGS. 1, 2, and 3, structural support system 14 is coupled to hull 12 and includes a hull support member (shown as a keel beam or track member 32, a front support 28, and a rear support 30. Structural support system 14 is configured to increase the rigidity of hull 12 and is configured to return (e.g., reflect, rebound, bounce back, spring back, return, etc.) at least a portion of input impact energy to the water. According to a preferred embodiment, structural support system is configured to return a substantial amount of the energy input from its environment (e.g., water, waves, rocks, logs, and other objects that may be encountered in the water).

According to an exemplary preferred embodiment, track member 32 provides a channel 34. Channel 34 is configured to receive slide 56 of adjustable seating system 16. According to a preferred embodiment, channel 34 is substantially in the shape of a "U" track. According to alternative embodiments, channel 34 may have any of a variety of shapes, including "V"-shape, U-shape with opposed flanges extending inwardly, and the like. According to an exemplary embodiment, channel 34 is held in place against the inside surface of hull 12 by front support 28 and rear support 30 by pressure between deck 42 and hull 12. According to a preferred embodiment, channel 34 is coupled to deck 43 of watercraft (and held in place by pressure) through and by front support 28, rear support 30 and adjustable seating 14 (i.e., cradle 60 and slide 58). According to an alternative embodiment, channel 34 is coupled to hull 12 by fasteners 36. According to a particularly preferred embodiment, track member 32 and/or channel 34 may be made of aluminum and powder coated. According to alternative embodiments, the track member may be made of any of a variety of sufficiently strong and light material.

Front support 38 and rear support 40 provide a relatively rigid support between an inner surface 22 of a bottom portion of hull 12 and an inner surface 22 of deck 42 to reinforce watercraft 10 and assist in preventing flexing of hull 12 or deck 42 and returning input energy to the water. Preferably, front support 38 and rear support 40 extend between track member 32 and deck 42. Front support 38 includes a front brace 44 (e.g., strut, member, etc.) and a front pillar 46. Rear support 40 includes a rear brace 48 (e.g., strut, member, etc.) and a rear pillar 50. Front brace member 44 and pillar 46 are coupled to track member 32, which extends substantially along a major axis 52 of inner surface 22 of a bottom portion of hull 12. Front brace 44 extends over a portion of front support pillar 46 to retain front support pillar 46 in place. Front support pillar 46 is shaped along its bottom surface to be received by track member 32. Track member 32 preferably extends from front end 54 of front support pillar 46 to a point between the ends of rear support pillar 50. Rear brace 48 extends over a portion of rear support pillar 50 to retain rear support pillar 50 in place. Rear support pillar 50 is shaped along its bottom surface to be received by track member 32. According to a preferred embodiment, front support pillar 46 and rear support pillar 50 may be made of a relatively rigid closed cell foam (e.g., molded, extruded, cast, etc.). According to a particularly preferred embodiment, front support pillar 46 and rear support pillar 50 are made from expanded polyethylene foam. According to alternative embodiments, the front support pillar and the rear support pillar may be made of any of a variety of suitably rigid, strong, and light material. According to a particularly preferred embodiment, front brace 44 and rear brace 48 are made of aluminum and powder coated. According to alternative embodiments, the braces may be made of any of a variety of sufficiently strong and light material.

Referring to FIG. 1, grab loops 56 are coupled to support system 14 by fasteners 57 that pass through apertures in the deck 42. Fasteners 57 couple grab loops 56 to front brace 44 and rear brace 48 (respectively). According to a particularly preferred embodiment, each of grab loops 56 may have two points at which to couple to the watercraft, and will be coupled to support system 14 to at least one of the points. According to alternative embodiments, the grab loops may be coupled to the support system at multiple points. According to a particularly preferred embodiment, grab loops 56 are made of aluminum. According to alternative embodiments, the grab loops may be made of any of a variety of materials (e.g., plastic, metal, etc.).

Referring to FIGS. 1, 2 and 3, adjustable seating system 16 is coupled to track member 32 of structural support system 14. The seating system 16 includes slide 58 selectively coupled to cradle 60 by fasteners 61. According to a preferred embodiment, slide 58 is located within (and engaged with) channel 34 provided by track member 32, and may move forward or rearward within and relative to track member 32. According to a particularly preferred embodiment, slide 58 has a substantially rectangular cross section. According to alternative embodiments, the slide may have any of a variety of cross sections compatible with the shape of channel 34. Slide 58 is retained or locked into one of a series of discreet positions by use of a pin 62 which, when in use, passes through an aperture 63 in track member 32 and an aperture 65 in slide 58 to prevent slide 58 from moving forward or rearward with respect to track member 32. Alternatively, any of a variety of pins or detents may be used to couple the slide to the track member (e.g., screws, bolts, pins, rivets, toggles, stops, or the like). According to a particularly preferred embodiment, slide 58 is made of aluminum. According to an alternative embodiment, the slide may be made from any of a variety of materials (e.g., plastic, metal, etc.). According to a particularly preferred embodiment, cradle 60 and slide 58 may be made of aluminum and powder coated. According to alternative embodiments, the cradle and the slide may be made of any of a variety of sufficiently strong and light material.

Cradle 60 is configured to receive seat cushion 82. Cradle 60 is coupled to slide 58 by fasteners 61. Cradle 60 comprises a base 64 and arms 66. Base 64 is substantially flat and horizontal with respect to the bottom portion of hull 12. Alternatively, the base may be arcuate or contoured (e.g., to conform with the shape of hull). Arms 66 are coupled to base 64 and are substantially vertical with respect to the bottom portion of hull 12. Arms 66 are provided with a grouping or series of apertures 68 which may be arranged in the form of a grid or other pattern. Each arm 66 also includes an extension 70 that is substantially parallel to base 64 and extends away from the other extension 70. Each extension 70 is provided with slots 72. Cradle 60 is coupled to watercraft 10 (preferably to deck 42) by fasteners 74 that pass through apertures in deck 42 and through slots 72 in extensions 70. According to an exemplary embodiment, arms 66 and/or extensions 70 are received in a recessed area of deck 42.

According to a preferred embodiment, channel 34 is coupled to deck 43 of watercraft (and held in place by pressure or friction) through and by front support 28, rear support 30 and adjustable seating 14 (i.e., slide 58 is coupled to track member 32 and cradle 60 is coupled to slide 58 and to coaming 94 and or deck 42).

Seating system 16 can be adjusted by removing pin 62 and loosening fasteners 74. Cradle 60 and slide 58 may then be moved forward or rearward along track member 32 to a desired position. When seating system 16 is in the desired position, pin 62 may be replaced, and fasteners 74 may be tightened to secure the seating system 16 in the desired position.

Hip pads 76 are coupled to cradle 60 using fasteners (e.g., screws, bolts, pins, rivets, toggles, stops, or the like). Fasteners 78 pass through apertures 80 in the hip pads 76 and through a corresponding set of apertures in the grouping of apertures 68 provided in arms 66. Orientation and adjustment of hip pads is configured depending on which apertures in the grid of apertures is selected. Hip pads 76 may be adjusted by loosening fasteners 78 such that hip pads 76 may be removed from arms 66. The apertures in the hip pads are then lined up with apertures in the grouping of apertures 68 that correspond to the desired position of hip pads 76. Fasteners 78 are then passed through apertures 80 in hip pads 76 as well as the corresponding apertures located in the groups of apertures 68 provided for in arms 66. Fasteners 78 are then tightened to secure hip pads 76 in the desired position. A seat cushion 82 may be attached to base 64 by use of fasteners, adhesive or any other suitable means of attachment (e.g. Velcro tape).

Figure 5:
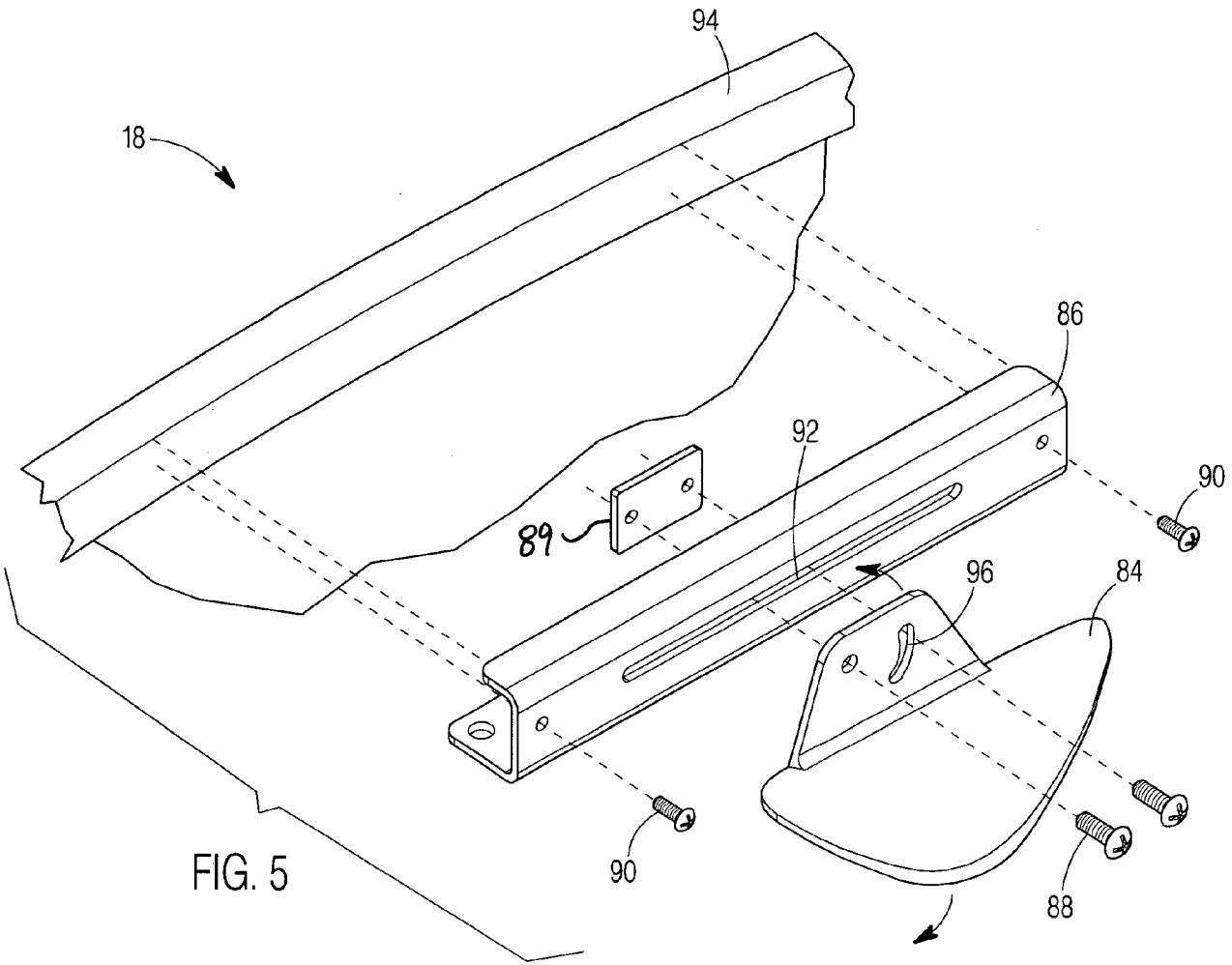
FIG. 5 is an exploded view of the adjustable thigh brace system.

Referring to FIGS. 1, 3, and 5, thigh brace system 18 includes a pair of thigh braces 84 and a pair of brace support members (shown as slot tracks 86). Thigh brace system 18 is configured to secure the kayaker in watercraft 10 and provide points where the kayaker can exert force on watercraft 10 to control the movement of watercraft 10. According to a preferred embodiment, braces 84 are coupled to slot tracks 86 by fasteners 88 engaged with a backing plate 89. Slot tracks 86 are coupled to the coaming 94 of watercraft 10 by fasteners 90. The use of slot tracks 86 allows for infinite longitudinal adjustment of thigh braces 84 within the range defined by the length of slots 92 within slot tracks 86. Linear or translational adjustment is made by first loosening fasteners 88, sliding thigh braces 84 to the desired position along slot tracks 86, and then tightening fasteners 88 (e.g., screws, bolts, pins, posts, etc.) to lock thigh braces 84 in the desired position. Thigh braces 84 are also configured for infinite rotatable or pivotal adjustment (e.g., within the range defined by a slots 96). The rotational adjustment is made by first loosening fasteners 98, rotating thigh braces 84 about fasteners 98 to a desired position, and then tightening fasteners 98 to lock thigh braces 84 in the desired position. According to a particularly preferred embodiment, thigh braces 84 are made of aluminum, anodized, and may be covered with a padded material. According to an alternative embodiment, the thigh braces may be made from any of a variety of materials, including plastic, metal, or the like. According to a particularly preferred embodiment, slot tracks 86 are made of extruded, anodized aluminum or other material that is sufficiently strong and rigid to provide structural support to coaming 94 and sufficiently light for use in a watercraft.

Referring to FIGS. 1 and 3, strap 100 is coupled to slot tracks 86 by fasteners 102. Strap 100 passes behind backrest 106 to limit the incline of backrest 106 with respect to seat cushion 82. Strap 100 passes through buckles 104. The incline of backrest 106 can be adjusted by increasing or decreasing the amount (e.g., length) of strap that passes between buckles 104 and behind backrest 106. According to alternative embodiments other types of buckles, ratchets, or connector may be used in place of the buckles. The amount of strap 100 that passes between buckles 104 may be changed by manually feeding strap 100 through buckle 104. Strap 100 is kept close to coaming 94 by strap guides 108. According to a preferred embodiment, buckles 104 and strap guides 108 may be made of anodized aluminum. According to alternative embodiments, any suitably strong and light material may be used (e.g., other metals or plastic or the like).

It is also important to note that the construction and arrangement of the elements of the seating and structural support system for watercraft as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the support system may comprise a single support (rather than front and rear support). Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A watercraft that receives impact energy from its environment during use, the watercraft comprising:

a hull;

a deck coupled to the hull;

an apparatus that provides structural support to the hull and the deck, the apparatus including:

a member disposed along an interior surface of the hull and extending along at least a portion of the longitudinal direction of the hull;

a first support coupled to the member and the deck;

wherein the first support comprises a brace and a pillar member captured between the brace and the member;

wherein the apparatus is configured to return at least a portion of the impact energy to the environment.

2. The watercraft of claim 1 wherein the member is retained in place by pressure exerted on the first support by the deck and the hull.

3. The watercraft of claim 1 further comprising a seat coupled to the apparatus and configured to be adjustable between at least a first position and a second position wherein the seat comprises a seating surface and a slide member configured to operatively engage the member.

4. The watercraft of claim 3 wherein the slide member includes a first hole and a second hole longitudinally displaced relative to the first hole, and the member includes a third hole, wherein the slide member may be moved so that the third hole aligns with either the first hole to locate the seat in the first position or with the second hole to locate the seat in the second position.

5. The watercraft of claim 4 further comprising a pin that may inserted through the holes to couple the slide member to the member and selectively retain the seat in the first position or the second position.

6. The watercraft of claim 1 wherein the member is made from aluminum.

7. The watercraft of claim 1 wherein the member comprises a U-channel configured to receive a portion of the pillar member.

8. The watercraft of claim 7 wherein the pillar member comprises a rigid closed cell foam.

9. The watercraft of claim 1 further comprising at least one grab loop coupled to the brace through the deck.

10. The watercraft of claim 1 wherein the first support is coupled to the member by one or more fasteners.

11. The watercraft of claim 1 wherein the apparatus further comprises a second support coupled to the member and the deck, wherein the first support is coupled proximate to a first end of the member and the second support is coupled proximate to a second end of the member.

12. The watercraft of claim 1 further comprising a brace support member coupled to the deck and a thigh brace selectively coupled to the brace support member, wherein the brace support member comprises a slot and the thigh brace comprises a linear slot and an arcuate slot, wherein a first fastener is inserted through the linear slot on the thigh brace and the slot on the brace support member and a second fastener is inserted through the arcuate slot on the thigh brace and the slot on the brace support member so that the thigh brace may be adjusted horizontally relative to the longitudinal direction of the watercraft, and pivotally.

13. The watercraft of claim 1 wherein the apparatus is configured to return substantially all of the impact energy to the environment.

14. The watercraft of claim 1 wherein the watercraft is a kayak.

15. An apparatus to provide structural support for a watercraft having a hull and a deck and configured to receive impact energy from its environment during use, the apparatus comprising:

a member coupled to the hull and extending along at least a portion of the longitudinal direction of the hull;

a first support coupled to the member and the deck;

wherein the first support comprises a brace and a pillar member captured between the brace and the member;

wherein the member and the first support are configured to return at least a substantial portion of the energy to the environment.

16. The apparatus of claim 15 wherein the member is made from aluminum.

17. The apparatus of claim 15 further comprising a seat coupled to the apparatus and configured to be adjustable between at least a first position and a second position wherein the seat comprises a seating surface and a slide member configured to operatively engage the member wherein the slide member includes a first hole and a second hole longitudinally displaced relative to the first hole, and the member includes a third hole, wherein the slide member may be moved so that the third hole aligns with either the first hole to locate the seat in the first position or with the second hole to locate the seat in the second position.

18. The apparatus of claim 15 wherein the member comprises a U-channel configured to receive a portion of the pillar member.

19. The apparatus of claim 15 wherein the pillar member comprises a rigid closed cell foam.

20. The apparatus of claim 15 wherein the apparatus further comprises a second support coupled to the member and to the deck, and wherein the first support is coupled proximate to a first end of the member and the second support is coupled proximate to a second end of the member.

21. The apparatus of claim 15 wherein the impact energy is in the form of at least one of a wave, a rock, or a log impacting the hull of the watercraft.

22. An apparatus to provide structural support for a watercraft having a hull and a deck and configured to receive impact energy from its environment during use, the apparatus comprising:

a member coupled to the hull and extending along at least a portion of the longitudinal direction of the hull;

a front support coupled to the deck and the member;

a rear support coupled to the deck and the member;

wherein the front support comprises a brace and a pillar member captured between the brace and the member;

wherein the member and the front support and the rear support are configured to return at least a portion of the impact energy from the watercraft to the environment.

23. The apparatus of claim 22 further comprising a brace support member coupled to the deck and a thigh brace selectively coupled to the brace support member, wherein the brace support member comprises a slot and the thigh brace comprises a linear slot and an arcuate slot, wherein a first fastener is inserted through the linear slot on the thigh brace and the slot on the brace support member and a second fastener is inserted through the arcuate slot on the thigh brace and the slot on the brace support member so that the thigh brace may be adjusted horizontally relative to the longitudinal direction of the watercraft, and pivotally.

24. The apparatus of claim 22 wherein the member comprises a U-channel configured to receive a portion of the pillar member.

25. The apparatus of claim 22 wherein the pillar member comprises a rigid closed cell foam.

26. A watercraft that receives impact energy from its environment during use, the watercraft comprising:

a hull;

a deck coupled to the hull;

an apparatus that provides structural support to the hull and the deck, the apparatus including:

a member disposed along an interior surface of the hull and extending along at least a portion of the longitudinal direction of the hull;

a first support coupled to the member and the deck;

a seat coupled to the apparatus and configured to be adjustable between at least a first position and a second position wherein the seat comprises a seating surface and a slide member configured to operatively engage the member;

wherein the slide member includes a first hole and a second hole longitudinally displaced relative to the first hole, and the member includes a third hole, wherein the slide member may be moved so that the third hole aligns with either the first hole to locate the seat in the first position or with the second hole to locate the seat in the second position;

wherein the apparatus is configured to return at least a portion of the impact energy to the environment.

27. A watercraft that receives impact energy from its environment during use, the watercraft comprising:

a hull;

a deck coupled to the hull;

an apparatus that provides structural support to the hull and the deck, the apparatus including:

a member disposed along an interior surface of the hull and extending along at least a portion of the longitudinal direction of the hull;

a first support coupled to the member and the deck;

a brace support member coupled to the deck;

a thigh brace selectively coupled to the brace support member;

wherein the brace support member comprises a slot and the thigh brace comprises a linear slot and an arcuate slot;

wherein a first fastener is inserted through the linear slot on the thigh brace and the slot on the brace support member and a second fastener is inserted through the arcuate slot on the thigh brace and the slot on the brace support member so that the thigh brace may be adjusted horizontally relative to the longitudinal direction of the watercraft, and pivotally;

wherein the apparatus is configured to return at least a portion of the impact energy to the environment.

* * * * *